United States Patent [19]

Vasconcellos

[11] Patent Number: 4,930,638

[45] Date of Patent: Jun. 5, 1990

[54] DENTURE BRUSH TRAVEL CASE

[76] Inventor: Rita L. Vasconcellos, 907 Sanford Road, Westport, Mass. 02790

[21] Appl. No.: 405,029

[22] Filed: Sep. 11, 1989

[51] Int. Cl.[5] ..... B65D 3/28; B65D 85/00

[52] U.S. Cl. ..... 206/581; 206/362.2

[58] Field of Search ..... 206/823, 209.1, 581, 206/38, 235, 362.1, 362.2, 361; 220/23.83, 23.8, 23.2; 215/317, 321

[56] References Cited

U.S. PATENT DOCUMENTS

| | | | |
|---|---|---|---|
| 942,058 | 12/1909 | DeGowin | 206/361 |
| 1,074,169 | 9/1913 | Fowler | 206/209.1 |
| 1,212,335 | 1/1917 | Feinberg | 206/209.1 |
| 1,446,520 | 2/1923 | Smith | 206/209.1 |
| 1,790,085 | 1/1931 | Barringer et al. | 206/209.1 |
| 1,961,437 | 6/1934 | Tuttle et al. | 206/38 R |
| 2,168,689 | 8/1939 | Smith et al. | 206/38 R |
| 2,177,504 | 10/1939 | Thompson . | |
| 2,576,551 | 11/1951 | Waters | 206/361 |
| 2,815,057 | 12/1957 | Tupper | 206/362.2 |
| 3,167,218 | 1/1965 | Graham | 215/321 |
| 3,207,296 | 9/1965 | Goodall | 206/209.1 |
| 3,326,358 | 6/1967 | Singleton | 220/23.83 |
| 3,450,452 | 6/1969 | Reid . | |
| 3,696,957 | 10/1972 | Van Baarn | 215/321 |
| 3,741,378 | 6/1973 | Parker . | |
| 3,746,162 | 7/1973 | Bridge . | |
| 4,037,746 | 7/1977 | VerHale | 215/321 |
| 4,166,552 | 9/1979 | Faulstich | 215/321 |
| 4,206,843 | 6/1980 | Rainey . | |
| 4,344,535 | 8/1982 | Calnazzi | 206/581 |
| 4,384,645 | 5/1983 | Manfredi | 206/235 |
| 4,564,113 | 1/1986 | Mendler | 215/321 |
| 4,577,771 | 3/1986 | Martinez | 215/321 |
| 4,699,287 | 10/1987 | Bullock | 215/321 |

FOREIGN PATENT DOCUMENTS

| | | | |
|---|---|---|---|
| 0684132 | 4/1964 | Canada | 206/361 |
| 0176279 | 4/1986 | European Pat. Off. | 215/317 |

*Primary Examiner*—Jimmy G. Foster
*Attorney, Agent, or Firm*—Jerry T. Kearns

[57] ABSTRACT

A denture brush travel case includes spaced parallel front and back walls, each forming a parallelogram and having parallel top and bottom edges connected by downwardly converging side edges. The front and back walls are connected by a pair of downwardly and inwardly converging rectangular side walls. A narrow end of the travel case is provided with a planar bottom wall, forming an open topped hollow receptacle. A hinged cap includes a dual seal construction for removable engagement with an open top portion of the travel case. In a second embodiment, the case includes a pair of compartments for storing a denture cleaning agent.

2 Claims, 3 Drawing Sheets

DENTURE BRUSH TRAVEL CASE

BACKGROUND OF THE INVENTION

1. Field of the Invention

The present invention relates to brush cases, and more particularly pertains to a denture brush travel case specifically designed for transporting a denture cleaning brush in a clean, sealed environment. A denture cleaning brush will not fit into conventional tooth brush holders, because it is too large. The denture brush user thus has a difficult time carrying the brush while travelling, and frequently resorts to a plastic bag for storing the brush. This can become messy, and does not provide a clean, sealed environment for the denture brush. In order to overcome these problems, the present invention provides a travel case for storing and transporting denture brushes.

2. Description of the Prior Art

Various types of brush cases are known in the prior art. A typical example of such a brush case is to be found in U.S. Pat. No. 2,177,504, which issued to 0. Thompson on Oct. 24, 1939. This patent discloses a tooth brush holder and container stopper for securing a tooth brush on a bathroom mirror by a suction cup stopper. U.S. Pat. No. 3,450,452, which issued to J. Reid on Jun. 17, 1969, discloses a brush holder having a circular hollow body portion connected to an elongated hollow stem portion, both adapted to be sealed by a removable cover. U.S. Pat. No. 4,206,843, which issued to R. Rainey on Jun. 10, 1980, discloses a container forming an integral cauterizing system. U.S. Pat. No. 3,741,378, which issued to M. Parker on Jun. 26, 1973, discloses a tooth brush protector having resilient end flaps across an open end to form an internal compartment containing a sanitizing agent. U.S. Pat. No. 3,746,162, which issued to R. Bridges on Jul. 17, 1973, discloses a tooth brush container having a hollow body portion and a hinged lid for engagement over the brush portion of a tooth brush.

While the above mentioned devices are directed to brush cases, none of these devices is a travel case suitable for storing and transporting a denture brush in a protected, sanitary environment. Additionally, none of the aforesaid devices disclose a denture brush travel case having front and back walls extending in spaced parallel relation and each formed as a parallelogram, with downwardly and inwardly converging rectangular elongated side walls extending transversely between the front and back walls. Additional features of the present invention, not contemplated by the aforesaid prior art devices, include the provision of a double sealed removable cap, and a pair of prismatic compartments for storing a denture cleaning agent. Inasmuch as the art is relatively crowded with respect to these various types of brush cases, it can be appreciated that there is a continuing need for and interest in improvements to such brush cases, and in this respect, the present invention addresses this need and interest.

SUMMARY OF THE INVENTION

In view of the foregoing disadvantages inherent in the known types of brush cases now present in the prior art, the present invention provides an improved denture brush travel case. As such, the general purpose of the present invention, which will be described subsequently in greater detail, is to provide a new and improved denture brush travel case which has all the advantages of the prior art brush cases and none of the disadvantages.

To attain this, representative embodiments of the concepts of the present invention are illustrated in the drawings and make use of a denture brush travel case which includes spaced parallel front and back walls, each forming a parallelogram and having parallel top and bottom edges connected by downwardly converging side edges. The front and back walls are connected by a pair of downwardly and inwardly converging rectangular side walls. A narrow end of the travel case is provided with a planar bottom wall, forming an open topped hollow receptacle. A hinged cap includes a dual seal construction for removable engagement with an open top portion of the travel case. In a second embodiment, the case includes a pair of compartments for storing a denture cleaning agent.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved denture brush travel case which has all the advantages of the prior art brush cases and none of the disadvantages.

It is another object of the present invention to provide a new and improved denture brush travel case which may be easily and efficiently manufactured and marketed.

It is a further object of the present invention to provide a new and improved denture brush travel case which is of a durable and reliable construction.

An even further object of the present invention is to provide a new and improved denture brush travel case which is susceptible of a low cost of manufacture with regard to both materials and labor, and which accordingly is then susceptible of low prices of sale to the consuming public, thereby making such brush cases economically available to the buying public.

Still yet another object of the present invention is to provide a new and improved denture brush travel case which provides in the apparatuses and methods of the prior art some of the advantages thereof, while simultaneously overcoming some of the disadvantages normally associated therewith.

Still another object of the present invention is to provide a new and improved denture brush travel case for storing and transporting a denture brush in a sanitary environment.

Yet another object of the present invention is to provide a new and improved denture brush travel case having a double sealed removable cap.

Even still another object of the present invention is to provide a new and improved denture brush travel case including a plurality of compartments for storing a denture cleaning agent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there ar illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
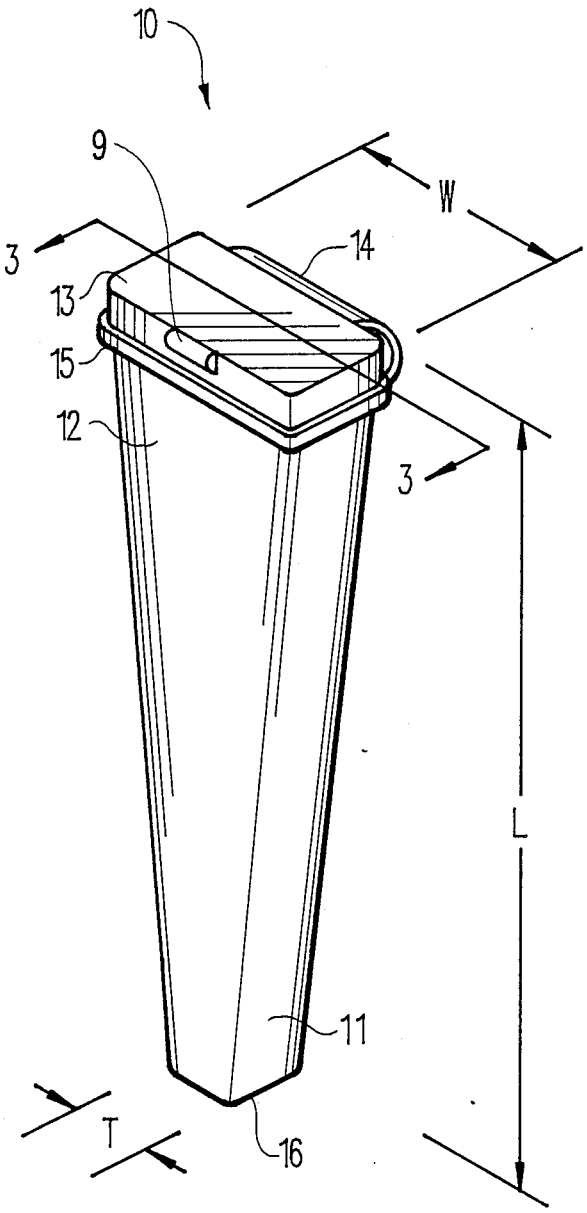
FIG. 1 is a perspective view of the denture brush travel case according to the present invention.

With reference now to the drawings, and in particular to FIG. 1 thereof, a new and improved denture brush travel case embodying the principles and concepts of the present invention and generally designated by the reference numeral 10 will be described.

More specifically, it will be noted that the first embodiment 10 of the invention includes a denture brush travel case having a parallelogram shaped front wall 12 having parallel top and bottom edges connected by downwardly converging side edges. A back wall of the case 10 is formed of an identical parallelogram shape as the front wall 12 and extends in spaced parallel relation therewith. A pair of downwardly and inwardly converging rectangular side walls, one of which is illustrated at 11, connect the front wall 12 with the parallel back wall. A radially outwardly extending rectangular peripheral flange 15 is formed around a top portion of the case 10. A removable snap-on type cap 13 includes a lip 9 to facilitate opening and is secured by a hinge 14 to the top portion of the back wall. The hinge 14 is formed by a resilient plastic strip. A square planar bottom surface 16 connects the lower edges of the front, back, and side walls. The travel case 10 comprises an open topped hollow receptacle and is dimensioned to receive a conventional denture cleaning brush. The travel case 10 has a length L of approximately six and one fourth inches and a top width of approximately two inches. The case 10 tapers to a bottom width T of about three fourths of an inch.

Figure 2:
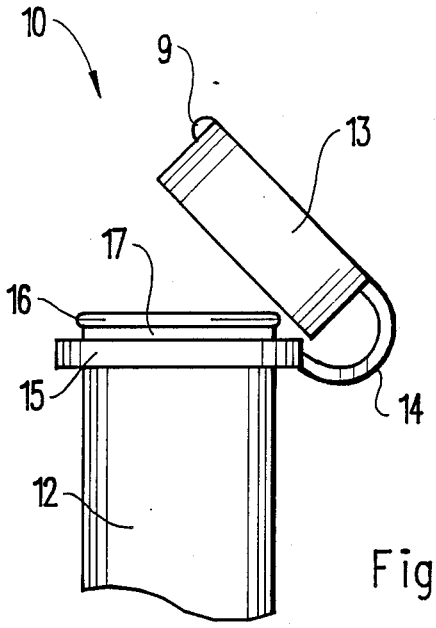
FIG. 2 is a partial side view illustrating the denture brush travel case of FIG. 1, with the removable cap in an open position.

As shown in FIG. 2, a reduced rectangular neck 17 extends upwardly above the peripheral flange 15 and includes an outwardly extending sealing flange 16.

Figure 3:
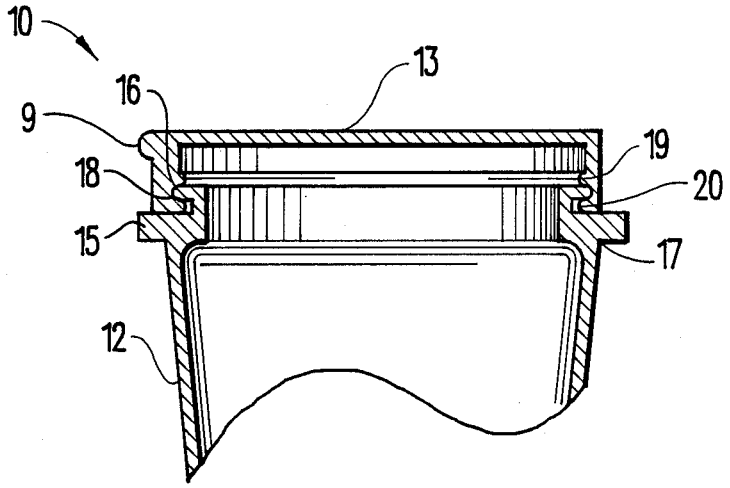
FIG. 3 is a cross sectional view, taken along line 3—3 of FIG. 1, illustrating the construction of the removable cap sealing arrangement.

FIG. 3 is a cross sectional view which illustrates the removable cap 13 in a sealed position. The cap 13 is formed as a shallow rectangular box and is provided with a pair of rectangular, internal, radially inwardly extending arcuate ribs 19 and 20 which form a sealing groove 18 dimensioned for frictional engagement with the sealing flange 16. The bottom end of the lower rib 20 abuts the upper surface of the peripheral flange 15 and forms a secondary seal. This provides a water tight enclosure and also affords a sanitary environment for transporting a denture cleaning brush.

Figure 4:
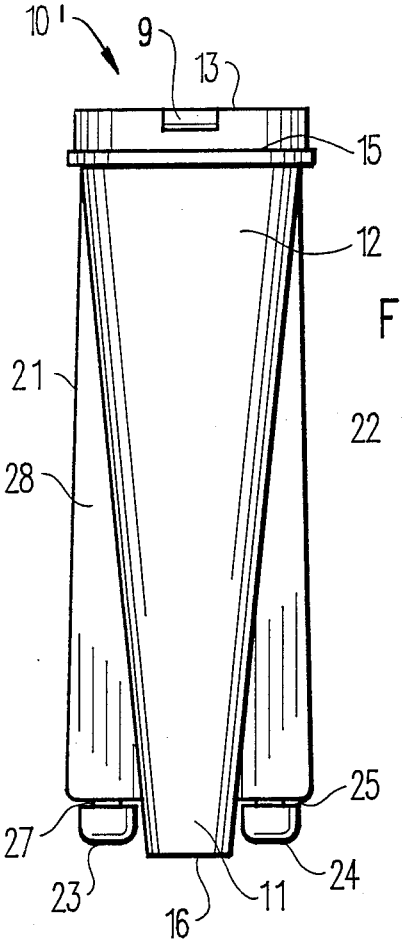
FIG. 4 is a front view illustrating a denture brush travel case according to a second embodiment of the present invention.

FIG. 4 illustrates an alternative embodiment 10' in which the travel case is formed identically as described with respect to FIGS. 1 through 3, with the exception that a pair of compartments are provided at opposite sides of the case 10' for storing a quantity of a denture cleaning agent. Each of the compartments includes an elongated rectangular end wall 21, 22 which connects a pair of spaced parallel triangular elongated side walls, two of which are illustrated at 26 and 28. A dispensing neck 25, 27 including a removable cap 24, 23, is provided on a bottom surface of each of the compartments. The compartments may store a quantity of a powdered, fluid or a tablet form of denture cleaning agent.

Figure 5:
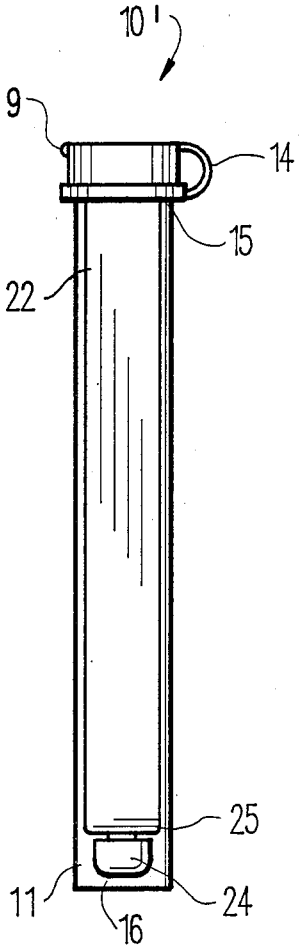
FIG. 5 is a side view of the denture brush travel case of FIG. 4.

FIG. 5 is a side view of the denture brush travel case 10'. As may now be understood, the present invention provides a sanitary travel case which allows conventional denture cleaning brushes to be conveniently stored and transported.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A denture brush travel case, comprising:

a front wall;

a back wall extending in spaced parallel relation with said front wall;

each of said front and back walls forming a parallelogram having parallel top and bottom edges connected by downwardly converging side edges;

said front and back walls connected by a pair of downwardly and inwardly converging rectangular side walls;

a square planar bottom wall extending between said front, back and side walls and forming an open topped hollow receptacle;

a removable cap for an open top portion of said receptacle;

a pair of prismatic compartments on said side walls for holding a cleaning agent;

each of said compartments including a dispensing neck disposed adjacent said bottom wall, and closed by a removable cover;

each of said compartments tapering from a smaller end adjacent said open top portion to a larger end adjacent said bottom wall; and each of said compartments including a pair of elongated spaced parallel side walls connected by an elongated rectangular end wall.

2. A denture brush travel case, comprising:

a front wall;

a back wall extending in spaced parallel relation with said front wall;

each of said front and back walls forming a parallelogram having parallel top and bottom edges connected by downwardly converging side edges;

said front and back walls connected by a pair of downwardly and inwardly converging rectangular side walls;

a square planar bottom wall extending between said front, back and side walls and forming an open topped hollow receptacle;

a removable cap for an open top portion of said receptacle;

said cap connected to said back wall by a hinge;

said hinge formed by a flexible plastic strip;

a radially outwardly extending rectangular peripheral flange formed around a top portion of said receptacle;

a reduced rectangular neck portion extending upwardly above said peripheral flange and including an outwardly extending sealing flange;

a pair of axially spaced internal ribs in said cap, said ribs forming a sealing groove dimensioned for engagement with said sealing flange, with one of said ribs in abutment with said peripheral flange and forming an outer seal;

a pair of prismatic compartments on said side walls for holding a cleaning agent;

each of said compartments including a dispensing neck disposed adjacent said bottom wall, and closed by a removable cover; and each of said compartments including a pair of elongated spaced parallel side walls connected by an elongated rectangular end wall.

* * * * *